US011303990B2

(12) United States Patent
Zhang et al.

(10) Patent No.: US 11,303,990 B2
(45) Date of Patent: Apr. 12, 2022

(54) SMALL EARPIECE ENHANCED ON-EAR DETECTION WITH MULTIPLE CAP SENSE

(71) Applicant: Plantronics, Inc., Santa Cruz, CA (US)

(72) Inventors: Yu Zhang, Suzhou (CN); Liying Wu, Suzhou (CN)

(73) Assignee: Plantronics, Inc., Santa Cruz, CA (US)

( * ) Notice: Subject to any disclaimer, the term of this patent is extended or adjusted under 35 U.S.C. 154(b) by 64 days.

(21) Appl. No.: 16/917,406

(22) Filed: Jun. 30, 2020

(65) Prior Publication Data

US 2021/0006890 A1 Jan. 7, 2021

(30) Foreign Application Priority Data

Jul. 4, 2019 (CN) ..... 201910599525.4

(51) Int. Cl.
*H04R 1/10* (2006.01)
*H04R 1/04* (2006.01)

(52) U.S. Cl.
CPC ..... *H04R 1/1075* (2013.01); *H04R 1/04* (2013.01); *H04R 1/1016* (2013.01); *H04R 1/1066* (2013.01)

(58) Field of Classification Search
CPC ..... H04R 1/1075; H04R 1/04; H04R 1/1016; H04R 1/1066
See application file for complete search history.

(56) References Cited

U.S. PATENT DOCUMENTS

| | | | | |
|---|---|---|---|---|
| 9,934,774 | B1 * | 4/2018 | Lin | G10K 11/17881 |
| 2008/0049961 | A1 * | 2/2008 | Brindisi | H04R 1/1041 381/380 |
| 2017/0094398 | A1 | 3/2017 | Cousins et al. | |
| 2019/0297408 | A1 * | 9/2019 | Mohammadi | H04R 1/1016 |
| 2020/0100010 | A1 * | 3/2020 | Yang | H04R 1/1041 |
| 2021/0014603 | A1 * | 1/2021 | Wei | G06F 3/044 |
| 2021/0067859 | A1 * | 3/2021 | Sakane | H01Q 1/273 |

* cited by examiner

*Primary Examiner* — Alexander Krzystan
*Assistant Examiner* — Julie X Dang
(74) *Attorney, Agent, or Firm* — Ferguson Braswell Fraser Kubasta PC

(57) ABSTRACT

An earpiece including an earbud. The earbud includes a stem having a proximal end and a distal end, a speaker disposed inside the stem at the distal end, and a sleeve disposed inside the stem. The earpiece also includes a housing connected to the proximal end of the stem. The housing contains firmware configured to communicate electronically with the speaker and to communicate wirelessly with an external device. The housing also contains curved partial sleeves. Each of the curved partial sleeves is adjacent an inner surface of a wall of the housing.

21 Claims, 4 Drawing Sheets

SMALL EARPIECE ENHANCED ON-EAR DETECTION WITH MULTIPLE CAP SENSE

BACKGROUND

An earpiece is a small electronic device having at least a speaker that may be placed, at least partially, in a user's ear in order to listen to a phone call or audio being produced by an external device, such as a mobile phone, television, or other device that produces audio signals. An earpiece may be a wireless device that communicates with the computing device via a wireless communication protocol.

SUMMARY

In general, in one aspect, one or more embodiments relate to an earpiece. The earpiece includes an earbud. The earbud includes a stem having a proximal end and a distal end, a speaker disposed inside the stem at the distal end, and a sleeve disposed inside the stem. The earpiece also includes a housing connected to the proximal end of the stem. The housing contains firmware configured to communicate electronically with the speaker and to communicate wirelessly with an external device. The housing also contains curved partial sleeves. Each of the curved partial sleeves is adjacent an inner surface of a wall of the housing.

One or more embodiments also relate to a method of automatically activating an earpiece. The method includes measuring a first change in electrical capacitance of a first sleeve disposed inside of a stem. The method also includes measuring changes in electrical capacitance of corresponding curved sleeves partially wrapped inside of a housing attached to the stem. The method also includes activating, automatically, the earpiece when the following conditions are satisfied: the first change in electrical capacitance exceeds a first threshold; and a preselected number of curved partial sleeves have changes in electrical capacitance which exceed corresponding individual thresholds set for each of the curved partial sleeves.

One or more embodiments also relate to a system including circuitry. The circuitry is configured to measure a first change in electrical capacitance of a first sleeve that is disposed inside a stem of an earpiece. The circuitry is also configured to measure changes in electrical capacitance of corresponding ones of curved partial sleeves that are adjacent an inner surface of a wall of a housing of the earpiece. The housing is connected to a proximal end of the stem. The circuitry is also configured to set the earpiece to an "on ear" condition automatically when the following conditions are satisfied: the first change in electrical capacitance exceeds a first threshold; and a preselected number of the curved partial sleeves have changes in electrical capacitance which exceed corresponding individual thresholds set for each of the curved partial sleeves.

Other aspects of the invention will be apparent from the following description and the appended claims.

DETAILED DESCRIPTION

Figure 1:
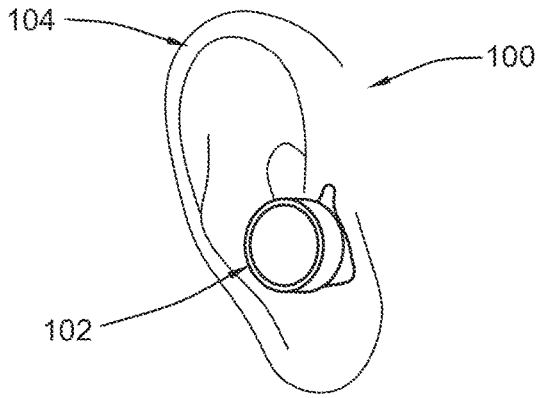
FIG. 1 depicts a wireless earpiece worn in an ear of a person, in one or more embodiments.

Specific embodiments of the invention will now be described in detail with reference to the accompanying figures. Like elements in the various figures are denoted by like reference numerals for consistency.

In the following detailed description of embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as by the use of the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

In general, embodiments of the invention relate to an earpiece, which is configured to communicate with an external device, such as a mobile phone, a tablet device, television, a desktop, a laptop, or any other computing device or device capable of wireless communication. The earpiece automatically detects whether the earpiece is in the auditory canal of a user, and in response, automatically sets the earpiece to an "on ear" condition. Using the techniques described further below, the process of determining the "on ear" condition has, compared to existing earpieces, a lower chance of false positives or false negatives. In other words, the earpiece of the one or more embodiments increases the probability that the earpiece correctly determines that the earpiece is actually in a user's auditory canal, relative to existing earpieces. The condition refers to the detected current state of the earpiece with respect to the person's ear. Namely, the "on-ear" condition means that the ear piece is detected as currently being worn by a person and the "off-ear" condition means that the earpiece is detected as not currently being worn by a person.

The earpiece includes at least two sets of curved sleeves disposed inside the earpiece. The first set of sleeves includes one or more sleeves that at least partially wrap around a speaker within a stem of the earpiece, the stem fitting inside of the user's auditory canal. The second set of sleeves includes two or more sleeves that at least partially wrap around an inside wall of a housing connected to the stem. The earpiece also includes circuitry or software which measures changes in the electrical capacitances of the first set of sleeves and changes in the electrical capacitances of the second set of sleeves. A pre-determined threshold is set for each of the different sleeves with respect to a total capacitance change measured. Optionally, other pre-determined thresholds are set for differences in electrical capacitance measured between the second set of sleeves. If more than a total, pre-determined number of thresholds are exceeded, then the earpiece reports an "on ear" condition, which may be used to automatically trigger activation of the earpiece, to cause the earpiece to start playing audio, or some other function. Otherwise, the earpiece reports an "off ear" condition and takes no action, pauses audio play, or switches the earpiece off. Other embodiments are described herein.

FIG. 1 depicts a wireless earpiece worn in an ear of a person, in one or more embodiments. Person (100) has placed an earpiece (102) inside his or her ear (104). A stem (not shown in FIG. 1; see FIG. 2 and FIG. 4) is disposed within the auditory canal of the ear (104) of the person (100).

The earpiece (102) is a computing device that communicates wirelessly, or perhaps in a wired manner, with an external device, such as any of the computing devices described above. Thus, the earpiece (102) allows a user to listen to audio produced by the external device privately and without the inconvenience of having to hold the external device adjacent the ear (104).

In order to maximize the convenience to the person (100), the earpiece is provided with physical hardware, as well as electronics and/or software, which allow the earpiece (102) to detect automatically whether the earpiece (102) has been placed inside the user's ear. When the earpiece (102) detects that the earpiece is inside the ear (104), the earpiece (102) sets itself to an "on ear" condition. Otherwise, the earpiece (102) sets itself to an "off ear" condition.

An "on ear" condition may switch on the electronic components necessary to communicate audio from the external device through the speaker (not shown in FIG. 1) of the earpiece so that the person (100) may listen to the audio. The "on ear" condition may also include other settings which governs how electrical components of the earpiece (102) draw power from a battery (not shown in FIG. 1; see FIG. 4) disposed in the earpiece (102). Otherwise, to save battery power, the earpiece is set to the "off ear" condition, in which a reduced amount of electrical power is used, perhaps only sufficient power necessary to detect when the earpiece (102) is placed inside the ear so that the "on ear" condition may be set. The "off ear" and "on ear" conditions may also be used merely to pause and resume audio playback, respectively.

However, a technical issue arises with respect to detecting when the earpiece (102) is actually placed in the ear (104) of the person (100). Specifically, the technical issue is minimizing false positive results and false negative results. A false positive result occurs when the earpiece (102) detects an "on ear" condition, but the earpiece (102) is not actually in the ear (104) of the person (100). A false negative result occurs when the earpiece (102) detects an "off ear" condition, but the earpiece (102) is actually in the ear (104) of the person (100).

In some cases, the issue of false positive results is more difficult to resolve than the issue of false negative results. For example, consider a case where an infrared light emitting diode (IRLED) in an earpiece (102) is used to identify an "on ear" condition. In this case, the IRLED transmits a specified frequency of infrared light. The earpiece has a separate infrared detector which detects a return signal of the same or similar frequency of infrared light that reflects off of a nearby surface (such as an ear canal of the ear (104)). A strong infrared signal will occur when the earpiece (102) is in the ear (104), indicating a "true positive" result and thus it is unlikely that a false negative result will occur. However, if the person (100) grasps the earpiece (102) with his or her fingers, then an infrared signal emitted by the earpiece (102) and then reflecting from the fingers can cause to earpiece (102) to set the earpiece (102) to the "on ear" condition, even though the earpiece is not actually in the ear (104). This false positive issue can continue if the person (100) carries the earpiece (102) in his or her hand, carries the earpiece (102) in his or her pocket, places the earpiece (102) very near another surface that efficiently reflects the infrared light, or if the earpiece (102) is placed in a warm place radiating a similar frequency of infrared light. As a result, the battery can be drained more quickly than desirable because the earpiece (102) is not actually in use, even though the earpiece (102) has detected the "on ear" condition.

A similar technical issue can occur when using a change in electrical capacitance or a change in electrical resistance to determine an on-ear condition. For example, when a person (100) grasps the earpiece (102), or places the earpiece (102) in the ear (104), the electrical resistance or the electrical capacitance of one or more components within the earpiece (102) may change. This change can be measured and then used to set the earpiece (102) to the "on ear" condition. However, the same technical issue described above occurs: a false positive can occur simply because the user grasps the earpiece (102) or places the earpiece (102) in a strong electric field or magnetic field, thus again leading to unnecessary and undesirable drain on the battery of the earpiece (102).

One or more embodiments address this issue by reducing the incidence of false negatives and false positives in detecting whether the earpiece (102) should be set to the "on ear" condition. One or more embodiments use changes in electrical capacitance in three or more different components within the earpiece (102), and compare those changes in capacitance to different individual thresholds.

Figure 2:
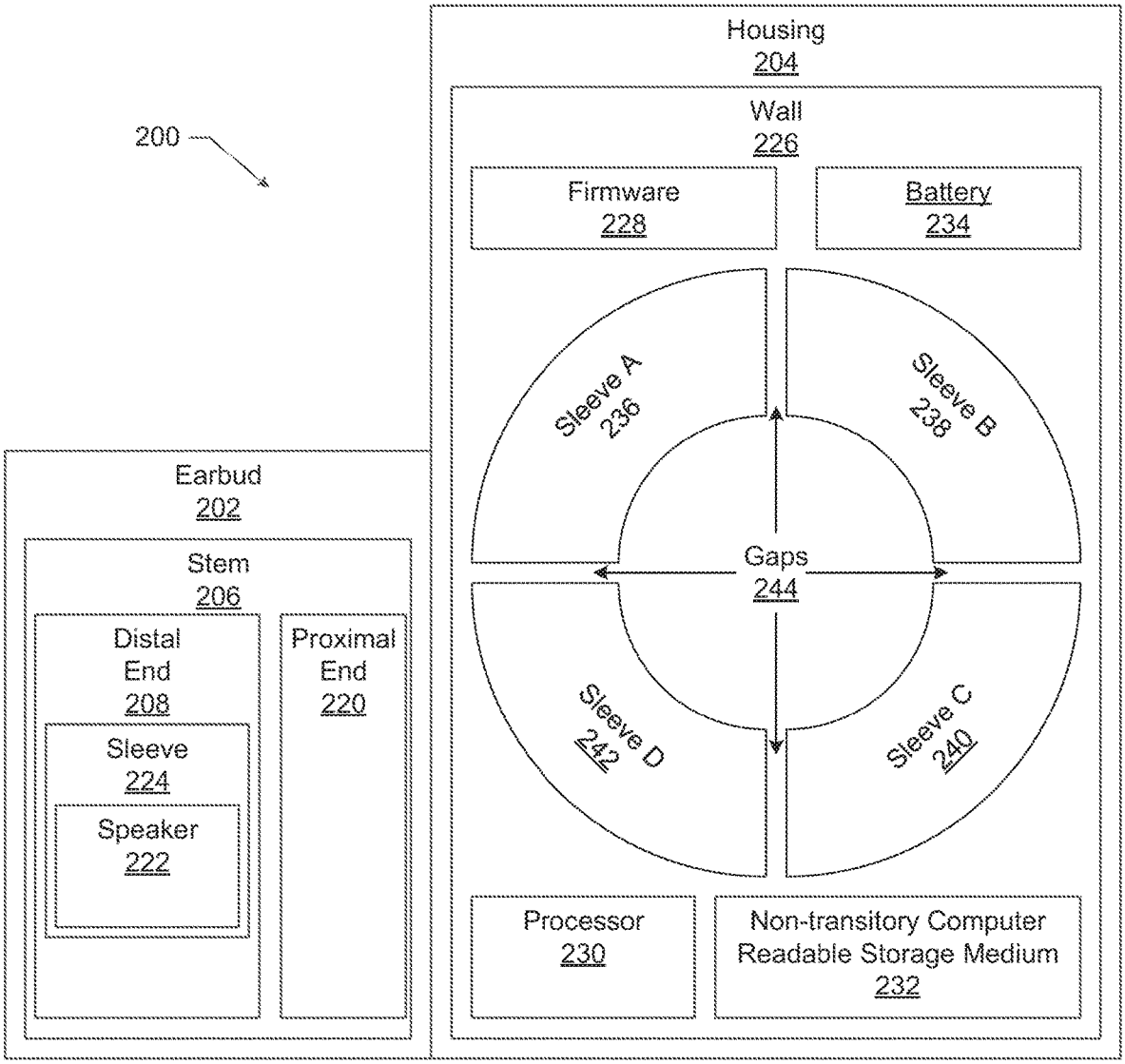
FIG. 2 is a schematic diagram of an earpiece, in one or more embodiments.

The components and structure used to accomplish this technical result are described with respect to FIG. 2. The procedures used to accomplish this technical result are described with respect to FIG. 3. A specific example of an earpiece is described with respect to FIG. 4, and a specific example of the procedure used to reduce false positive and false negatives in determining the "on ear" and "off ear" conditions is described with respect to FIG. 5.

Attention is now turned to FIG. 2. FIG. 2 is a schematic diagram of an earpiece, in one or more embodiments. The earpiece (200) may be the earpiece (102) of FIG. 1.

The earpiece (200) includes an earbud (202) and a housing (204). The earbud (202) is sized and dimensioned to fit at least partially within an auditory canal of a human. The housing (204) may be integrally formed with, or may be separately connected to, the earbud (202). For example, in order to fit within a human ear, the earbud (202) may be connected to the housing by a stem (206), which may be integrally formed with both the earbud (202) and the housing (204), or may be otherwise connected to the earbud (202) and the housing (204).

Turning first to details regarding the earbud (202), the earbud (202) is composed of a material suitable for placement inside the auditory canal of a person. In one embodiment, the material may be plastic, though many other materials are suitable for this purpose.

The earbud (202) also includes the stem (206). The stem (206) includes a distal end (208) and a proximal end (220). The terms "distal" and "proximal" are defined with respect to the housing (204), such that when the earpiece (200) is in a human ear, the distal end (208) of the stem is most deeply inside the ear. The proximal end (220), which is opposite the distal end (208), is connected to the housing (204).

Within the distal end (208) of the stem (206) of the earbud (202) is a speaker (222). The speaker (222) is configured to produce sound waves (i.e., to reproduce the speech, music, or other audio to which the person can listen).

Inside the stem (206) in the distal end (208) of the earbud (202), is a sleeve (224). The sleeve (224) may be wrapped at least partially around the speaker (222). For example, the sleeve (224) is, in one embodiment, a one-piece cylindrical ribbon of copper that is wrapped entirely around the speaker (222). However, in other embodiments, the sleeve (224) may be varied.

For example, the sleeve (224) may be made of other materials, including but not limited to nickel, aluminum, gold, iron, or other metals. Because the embodiments contemplate measuring a capacitance change in the sleeve (224) when the earbud (202) or the stem (206) is grasped by human fingers or is placed inside an ear, the sleeve (224) may have a conductivity similar to such metals. However, the sleeve (224) may be composed of many different materials, and thus need not be metal. Nevertheless, the sleeve (224) should be composed of a material such that when a human finger grasps the earbud (202) or the stem (206), or when the stem (206) is placed inside an ear, a change in electrical capacitance of the sleeve (224) can be measured.

In another variation, the sleeve (224) may be replaced by multiple partial sleeves that wrap only partially around the speaker (222). Thus, the sleeve (224) may be characterized in another embodiment as two or more curved ribbons of material, such as the material described above. In still another variation, the sleeve (224) may be a solid cylinder or block (or any other shape) of material, such as the materials described above, which are disposed inside the stem (206) or other portion of the earbud (202) which is in or near the distal end (208) of the earbud (202).

Attention is now turned to the components of the housing (204), to which the proximal end (220) of the stem (206) of the earbud (202) is connected. The housing (204) is characterized by a wall (226) which defines the outer dimensions of the housing (204). The wall (226) may be composed of any material suitable for grasping the earpiece (200) by a person, such as plastic or any other suitable material. The wall (226) of the housing (204) may be made of the same material as the earbud (202), such that the housing (204) and the earbud (202) form a single integrated (e.g., monocoque) body. Alternatively, the earbud (202) may be removably attached to the housing (204). The term "removably attached" means that structures are present on the objects being connected that allow the objects to be repeatedly connected and disconnected.

Disposed inside the wall (226) of the housing (204) is firmware (228) which may include a processor (230). Together, the firmware (228) and processor (230) provide the circuitry to operate the earpiece (200). The circuitry may be entirely firmware programmed to execute the procedures described herein with respect to automatically detecting an "on ear" or "off ear" condition. However, the circuitry may also include a non-transitory computer readable storage medium (232) which store instructions that, when executed by the processor (230), perform a computer-implemented method that executes the procedures described herein with respect to automatically detecting an "on ear" or "off ear" condition. Details regarding this procedure are described with respect to FIG. 3 and FIG. 5.

The circuitry may also provide the firmware and/or software used to communicate, via either a wired or wireless electronic connection, with an external device. The external device is a device that is not a part of the earpiece (200). In other words, the external device is separate from the earpiece and not in the housing (204) or earbud (202) of the earpiece (200). The external device may be a mobile phone, a tablet, a computer, or some other computing device, as well as any other device capable of wireless communication. In this manner, signals produced by the external device are electronically communicated to the circuitry of the earpiece (200), and then processed by the circuitry of the earpiece (200) to produce sound waves at the speaker (222) so that the user can hear the "audio" produced by the external device.

Also inside the housing (204) are two or more partially curved sleeves. The partially curved sleeves are composed of materials similar to those described above for sleeve (224). In an embodiment, the two or more partially curved sleeves are each partially wrapped around a body of a battery (234) which supplies electrical power to the earpiece (200). In another embodiment, the two or more partially curved sleeves are disposed just inside, and possibly connected to, an inside surface of the wall (226) of the housing (204). In an embodiment, intervening components, such as but not limited to part or all of the firmware (228), processor (230), and non-transitory computer readable storage medium (232), or perhaps support structures for the battery (234) or other components may be disposed between the inside surface of the wall (226) and the two or more partially curved sleeves. However, in still another embodiment, some empty space may exist between the inside surface of the wall (226) and the two or more partially curved sleeves.

In the embodiment of FIG. 2, the two or more partially curved sleeves include four sleeves: sleeve A (236), sleeve B (238), sleeve C (240), and sleeve D (242). However, the one or more embodiments contemplate the use of more or fewer sleeves, though two or more sleeves are present within the housing (204). In the embodiment shown in FIG. 2, the four partially curved sleeves are ribbons formed into approximately semi-hemispherical shapes. A semi-hemispherical shape is a shape curved into about a ninety degree angle around a common imaginary center. The term "approximately semi-hemispherical" is used, because gaps (244) may be present between each sleeve. The gaps (244) may establish additional electrical capacitance between the two or more partially curved sleeves, in addition to the capacitance that can arise simply because a given sleeve is curved. In an embodiment, the two or more partially curved sleeves may be disposed around a common central point and vertically aligned with each other, relative to the housing (204).

Figure 3:
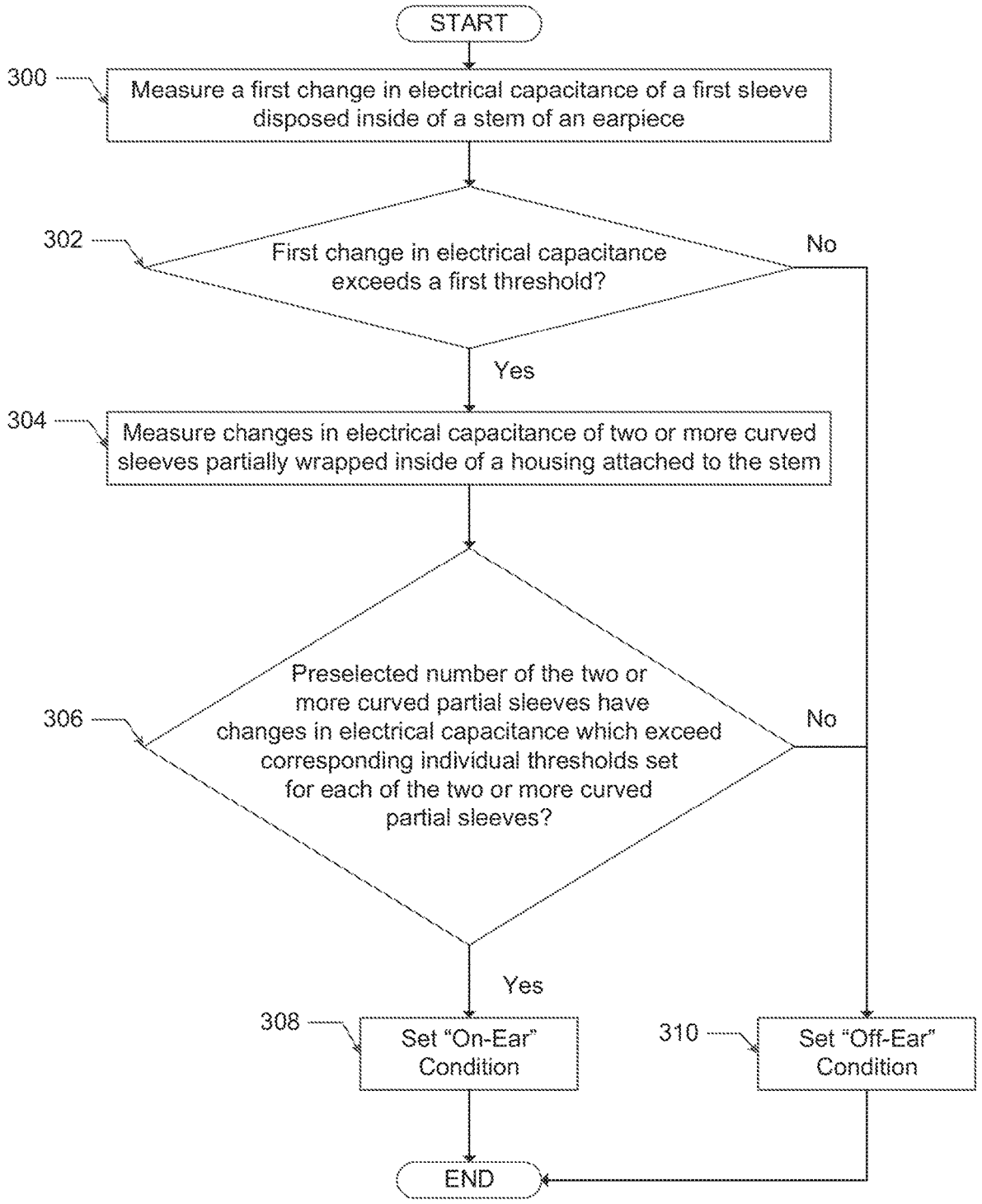
FIG. 3 is a flowchart of a method, in one or more embodiments.

FIG. 3 is a flowchart of a method, in one or more embodiments. The method shown in FIG. 3 may be performed using the earpiece (102) of FIG. 1 or earpiece (200) of FIG. 2.

At step 300, a first change is measured in an electrical capacitance of a first sleeve disposed inside of a stem of an earpiece. Because the sleeve is curved, and has sufficient conductivity, electrical energy may be stored between curved portions of the ribbon that forms the sleeve. The ability of the first sleeve to store electrical energy is called electrical "capacitance," which is a quantitative value that can be measured. When a change in the electric field in or near the sleeve takes place, a change in the capacitance of the first sleeve also takes place. Additionally, it is possible that a change in the temperature of the sleeve can change the electrical resistivity of the sleeve, thereby also changing the capacitance of the sleeve.

The change in electrical capacitance is caused by any number of changes in the environment. The change could be caused by a user picking up the earpiece by the stem, could be caused by placing the earpiece inside the user's ear, could be caused by placing the earpiece in an electromagnetic field, could be caused by a placing the ear piece near a heat source other than a person's body heat, or could be caused by any number of different environmental changes. The earpiece cannot, by itself, determine which of these causes is the actual cause of the capacitance change, as all that the earpiece detects is the capacitance change in the first sleeve at this point.

The change in capacitance in the first sleeve is measured by a processor, possibly in conjunction with software stored on a non-transitory computer readable storage medium in the earpiece. Alternatively, the change in capacitance may be measured by firmware contained within the earpiece. The change in capacitance in the first sleeve may be termed a "first change."

At step 302, a determination is made whether the first change in electrical capacitance exceeds a first threshold. The first threshold is a pre-determined number selected by an engineer or perhaps by an automated software program. The first threshold is set at a value that is near or above a capacitance change expected to occur when the earpiece is placed in an ear. Thus, capacitance changes in the first sleeve that are substantially less than what is expected when the earpiece is placed in an ear will be ignored. As used herein, the term "near" and "substantially less" refer to a pre-selected range of values as determined by an engineer or a software program. In one non-limiting example, "near" or "substantially less" is measured with respect to within ten percent of an expected value, though this percentage may be varied.

If the change in electrical capacitance in the first sleeve is less than or equal to the first threshold (a "no" answer to step 302), then the firmware and/or software sets the earpiece to the "off-ear" condition at step 310. The process then terminates.

However, if the change in electrical capacitance in the first sleeve is greater than the first threshold (a "yes" answer to step 302), then changes in electrical capacitances are measured in the other remaining sleeves that are disposed in the housing. Specifically, at step 304, changes are measured in the electrical capacitance of two or more curved sleeves partially wrapped inside of a housing attached to the stem. Again, the processor and software and/or the firmware make these measurements. A separate measurement is taken of each change in electrical capacitance between each of the two or more curved sleeves. Thus, if two sleeves are present, then two measurements are taken, if three sleeves are present, then three measurements are taken, and so on.

At step 306, a determination is made whether a preselected number of the two or more curved partial sleeves have changes in electrical capacitance which exceed corresponding individual threshold set for each of the two or more curved partial sleeves. Stated differently, each separate measurement in electrical capacitance is compared to a corresponding distinct threshold value. Thus, for example, if two sleeves are present, then two thresholds exist, if three sleeves are present, then three thresholds exist, and so on. Each threshold may be different than the other. However, in another embodiment, each threshold may be the same and stored as a single value. In still another embodiment, two or more of the thresholds may be the same, but one or more of the remaining thresholds may be different.

The thresholds are pre-determined number selected by an engineer or perhaps by an automated software program. The thresholds are set at values, or a combination of values, that are near or above a capacitance change expected to occur when the earpiece is placed in an ear. Thus, capacitance changes in the first sleeve that are substantially less than what is expected when the earpiece is placed in an ear will be ignored.

In an embodiment, experimentation may have informed the engineer as to which combination of changes in capacitance in the various sleeves is most likely represent that the earpiece is actually in a person's ear. For example, by experimenting with many different persons' ears and by measuring each change in capacitance many times both off ear and on ear, and in different temperature and electrical environments, the engineer could expect to see a certain number of thresholds exceeded when the earpiece is actually in a person's ear. In alternative embodiments, one or more a specific combinations of specific thresholds being exceeded may be indicative of an "on ear" or "off ear" condition.

In a specific example, assuming that there are four partially wrapped curved sleeves with four associated thresholds, if the first threshold is at W picofarads of capacitance, a second threshold is at X picofarads of capacitance, the third threshold is at Y picofarads of capacitance, and the fourth threshold is at Z picofarads of capacitance, then it is expected (by experience) that the earpiece is actually in an ear. In another specific example, the corresponding individual thresholds are all different, and a given threshold in the corresponding individual thresholds is greater than another threshold in the corresponding individual thresholds when a corresponding curved partial sleeve is closer to the stem relative to another curved partial sleeve. In other words, it is expected that the closer a sleeve will be to a user's ear when the earpiece is in use, the greater the change in capacitance that will be measured. In any case, the precise threshold value for each of the partially wrapped curved sleeves within the housing of the earpiece may be measured and evaluated during use of the earpiece, with each threshold set beforehand based on empirical evaluation.

In an embodiment, not all of the thresholds of the different capacitances of the sleeves in the housing need be exceeded in order to trigger an "on-ear" condition. For example, it may be considered by an engineer sufficient that three of four thresholds have been exceeded in order to set an "on-ear" condition. However, in other embodiments, all of the thresholds must be met in order to set an "on-ear" condition. The total number of thresholds that must be met (i.e., the preselected number) in order to satisfy the condition of step 306 may be varied in different embodiments.

Returning to FIG. 3, if the preselected number of thresholds have not been exceeded (a "no" determination at step 306), then the earpiece is set to an "off-ear" condition, and the method terminates. Otherwise, (a "yes" determination at step 306), the earpiece is set to the "on ear" condition. Again, the firmware and/or software perform the actual setting of the "on-ear" or "off-ear" condition, as well as determine the exact change in firmware or power settings of the earpiece based on the condition set.

Figure 4:
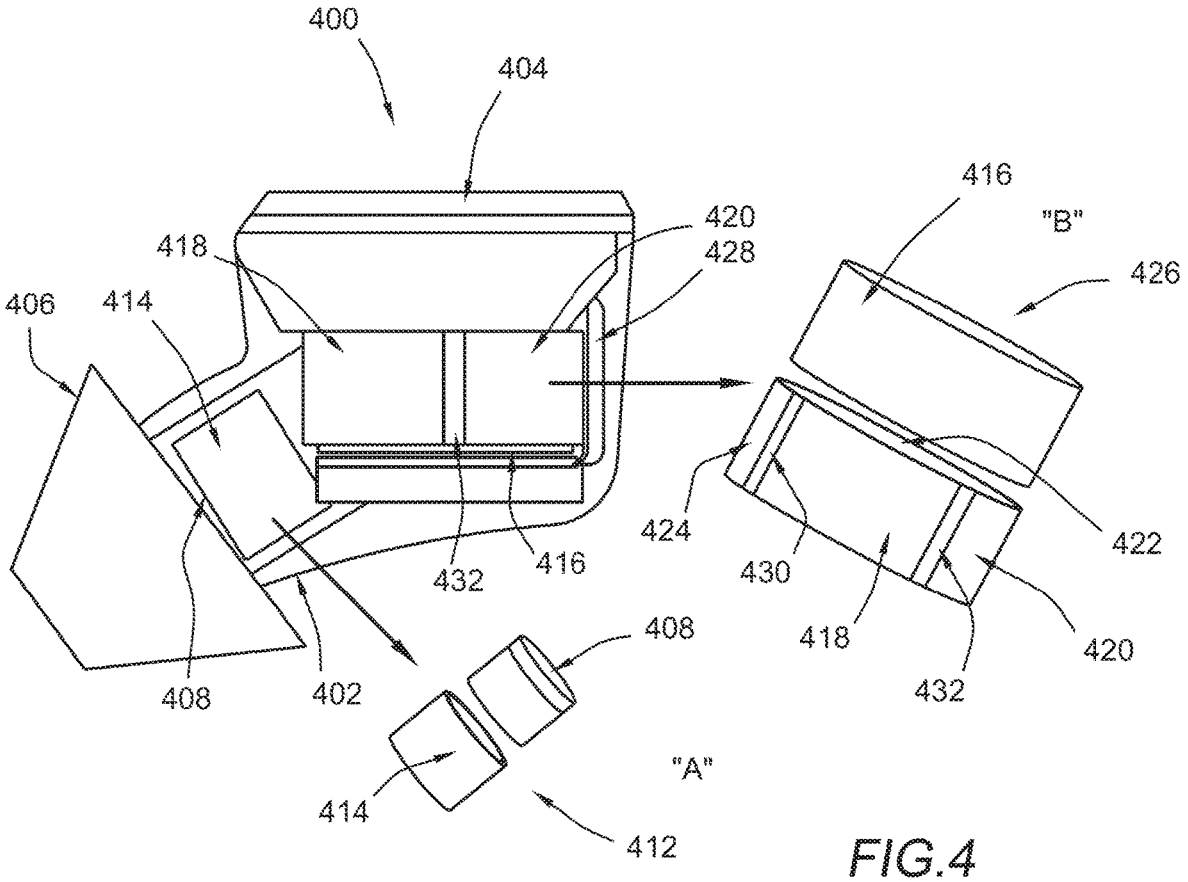
FIG. 4 is a partially exploded view of an earpiece, one or more embodiments.

FIG. 4 is a partially exploded view of an earpiece, in one or more embodiments. The earpiece (400) shown in FIG. 4 is a variation of earpiece (102) of FIG. 1 and earpiece (200) shown in FIG. 2. The method shown in FIG. 3 may be executed using the earpiece (400) shown in FIG. 4. The earpiece (400) may be considered a specific implementation of the one or more embodiments, and thus is a non-limiting example only.

The earpiece (400) includes stem (402) extending from housing (404). In this example, the stem (402) and the housing (404) are a monocoque piece of plastic. However, in other embodiments, the stem (402) may connect, perhaps removably connect, to the housing (404). A flange (406) formed from a soft, compliant material suitable for insertion into a person's ear may aid in holding the earpiece (400) inside the auditory canal of the person.

Figure 5:
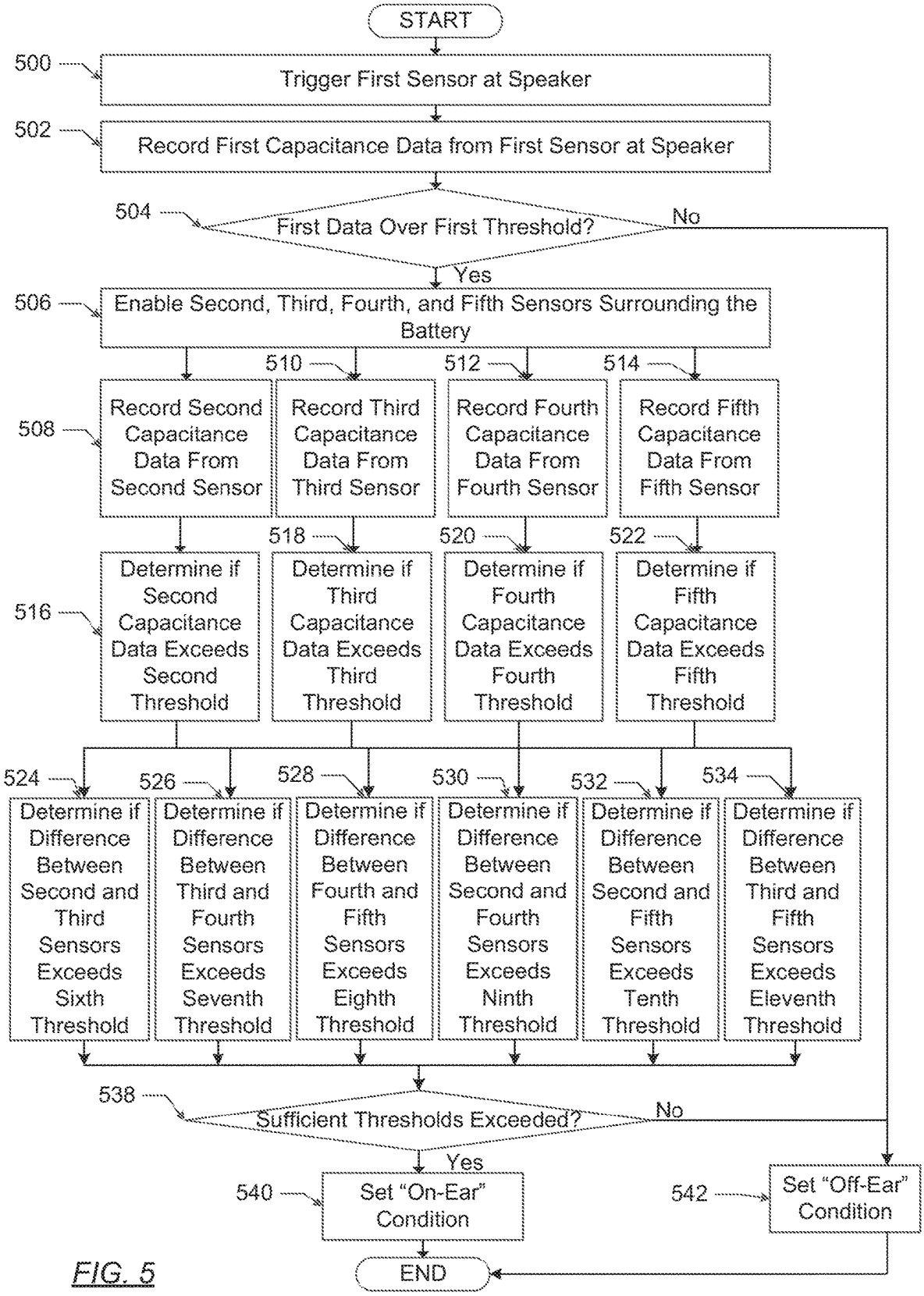
FIG. 5 is a flowchart of a method, in one or more embodiments.

Within the stem (402) is a speaker (408) connected to firmware (410) and/or other circuitry (including possibly a processor and a non-transitory computer readable storage medium) that is disposed within the housing (404). As better shown in the exploded portion A (412) of FIG. 4, sleeve A (414) is wrapped entirely around the speaker (408). In different embodiments, the sleeve A (414) may wrap partially around the speaker (408). In other embodiments, the sleeve (414) may be broken up into two or more partially curved sleeves. The sleeve A (414) may be composed of a metal, such as copper, or other similarly conductive material as described above with respect to FIG. 2. Because the sleeve A (414) forms a tube with at least two opposed sections of sufficiently conductive material, a capacitance exists within the sleeve A (414). This capacitance can be measured and, as described with respect to FIG. 5, compared to an individually set threshold value.

The housing (404), in addition to including the firmware (not shown) also includes a battery (416) that supplies power to the firmware, a speaker (408), and possibly other electrical components of the earpiece (400). In the embodiment shown in FIG. 4, wrapped around the battery, just inside the inner wall of the housing (404), are four curved partial sleeves: sleeve B (418), sleeve C (420), sleeve D (422), and sleeve E (424). Each of the four sleeves may be composed of a metal, such as copper, or other similarly conductive material, as described with respect to FIG. 2.

A gap exists between each pair of sleeves. Thus, as shown in exploded portion B (426), a gap A (430) exists between sleeve D (424) and sleeve B (418), and a gap B (432) exists between the sleeve B (418) and the sleeve C (420). In an embodiment, a corresponding capacitance exists across each of the gaps. These capacitances can be measured and, as described with respect to FIG. 5, compared to corresponding, individually-set threshold values.

Support infrastructure (428) may be disposed inside the housing (404) in order to support the sleeves and the battery (416) in a pre-selected arrangement. In this manner, the four sleeves may be arranged around a common central point within the housing (404) and possibly vertically aligned with each other.

FIG. 5 is a flowchart of a method, in one or more embodiments. The method shown in FIG. 5 may be implemented using the earpiece (400) of FIG. 4. The method shown in FIG. 5 is a variation of the method shown in FIG. 3.

At step 500, a first sensor at the speaker is triggered. The first sensor is the sleeve A (414) wrapped around the speaker in FIG. 4. The first sensor is triggered when a change in capacitance is detected with respect to the sleeve A (414) in FIG. 4.

At step 502, first capacitance data is recorded from the first sensor at the speaker. The first data is the change in capacitance in the first sensor. The first capacitance data may be recorded by the firmware, such as firmware (410) of FIG. 4.

At step 504, a determination is made whether the first data is over a first threshold. The threshold is pre-selected, and may be set empirically based on a capacitance value expected when the earpiece is placed in the auditory canal of a person. If the first data is not over the threshold (a "no" answer to step 504), then at step 542, the earpiece is set to an "off-ear" condition. The method terminates at that point. Thus, stated differently, a pre-condition of determining an on-ear condition for the earpiece may be the determination that the first sensor is over the first threshold.

Otherwise (a "yes" answer to step 504), then at step 506, second, third, fourth, and fifth sensors surrounding the battery are enabled. Each sensor may be curved partial sleeve that wraps partially around the battery. Gaps may exist between each curved partial sleeve. A capacitance may be measured both in the gaps, as well as inside a curved portion of any given sleeve. A sensor is considered "enabled" when the firmware is permitted to start recording capacitance data. Otherwise, no data is recorded from the second, third, fourth, and fifth sensors. In this manner, a capacitance measured at the first sensor must exceed the first threshold in order for capacitance data to start being recorded at or between the second, third, fourth, and fifth sensors.

Next, steps 508, 510, 512, and 514 are performed in parallel. However, the steps do not necessarily have to be performed in parallel. For example, the steps may be performed in a pre-selected sequence. At step 508, second capacitance data is recorded from the second sensor. At step 510, third capacitance data is recorded from the third sensor. At step 512, fourth capacitance data is recorded from the fourth sensor. At step 514, fifth capacitance data is recorded from the fifth sensor. The second, third, fourth, and fifth capacitance data may be recorded by the firmware, such as firmware (410) of FIG. 4, or by software when executed by a processor.

Thereafter, steps 516 through 534 are performed in parallel. However, the steps do not necessarily have to be performed in parallel. In another embodiment, and of steps 516 through 534 may be performed in a pre-selected sequence. Additionally, groups of the steps could be performed in parallel, with remaining groups of the steps performed in a pre-selected sequence.

At step 516, a determination is made if the second capacitance exceeds the second threshold. At step 518, a determination is made if the third capacitance exceeds the third threshold. At step 520, a determination is made if the fourth capacitance exceeds the fourth threshold. At step 522, a determination is made if the fifth capacitance exceeds the fifth threshold. The success (exceeded) or failure (not exceeded) of each determination is simply recorded at this point. Each determination may be made and recorded by the firmware, such as firmware (410) of FIG. 4.

In addition to steps 516 through 522, the relative differences between the capacitances recorded by the four sensors disposed around the battery are also determined and compared to still more thresholds. In other words, between any two sensors, a difference in capacitance can be recorded and then compared to an individual threshold.

Thus, at step 524, a determination is made if the capacitance difference between the second and third sensors exceeds a sixth threshold. Similarly, at step 526, a determination is made if the capacitance difference between the third and fourth sensors exceeds a seventh threshold. At step 528, a determination is made if the capacitance difference between the fourth and fifth sensors exceeds an eighth threshold. At step 530, a determination is made if the capacitance difference between the second and fourth sensors exceeds a ninth threshold. At step 532, a determination is made if the capacitance difference between the second and fifth sensors exceeds a tenth threshold. At step 534, a determination is made if the capacitance difference between the third and fifth sensors exceeds an eleventh threshold.

Next, at step 538, a determination is made whether sufficient thresholds have been exceeded. In other words, a determination is made whether enough of the second, third, fourth, fifth, sixth, seventh, eighth, ninth, tenth, and eleventh thresholds have been exceeded in order to continue. Exactly how many thresholds need to be exceeded in order to be considered "sufficient" is a value that is pre-determined. The pre-determined value may be selected empirically by experiment, noting how often less than all of the thresholds being exceeded still accurately will result in an "on-ear" condition of the earpiece. In an example, ten or more thresholds could be used. However, the actual pre-determined value may be a design choice between accuracy (the more thresholds used, the more accurate the "on ear" determination) and speed of calculation (the more thresholds used, the longer the processing or calculation time, leading to a possible delay in a prompt being sent to the user that the earpiece is "on ear" and ready for use). Note that the pre-determined value may be changed, in some embodiments, via a software or firmware update later provided to the earpiece. In any case, the determination may be made and recorded by the firmware, such as firmware (410) of FIG. 4, or by software executed by a processor.

If an insufficient number of thresholds have been exceeded (a "no" determination at step 538), then the firmware sets the "off-ear" condition for the earpiece at step 542. The method of FIG. 5 may terminate thereafter. Otherwise, if a sufficient number of thresholds have been exceeded (a "yes" determination at step 538), then, at step 540, the firmware sets the "on-ear" condition for the earpiece. The method of FIG. 5 may terminate thereafter.

Software instructions in the form of computer readable program code to perform embodiments of the invention may be stored, in whole or in part, temporarily or permanently, on a non-transitory computer readable medium such as a CD, DVD, storage device, a diskette, a tape, flash memory, physical memory, or any other computer readable storage medium. Specifically, the software instructions may correspond to computer readable program code that, when executed by a processor(s), is configured to perform one or more embodiments of the invention.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. An earpiece comprising:

an earbud comprising:

a stem having a proximal end and a distal end, a speaker disposed inside the stem at the distal end, and a sleeve disposed inside the stem, wherein the sleeve is curved; and a housing connected to the proximal end of the stem, the housing containing:

firmware configured to communicate electronically with the speaker and to communicate wirelessly with an external device, a plurality of curved partial sleeves, each of the plurality of curved partial sleeves adjacent an inner surface of a wall of the housing; and a processor in communication with the firmware, the sleeve, and the plurality of partially curved sleeves, the processor programmed to:

measure a first change in electrical capacitance of the sleeve, wherein the electrical capacitance of the sleeve is established between curved portions of the sleeve, measure a plurality of changes in electrical capacitance of corresponding ones of the plurality of curved partial sleeves, and set the earpiece to an "on ear" condition when the following conditions are satisfied:

the first change in electrical capacitance exceeds a first threshold, and a preselected number of the plurality of curved partial sleeves have changes in electrical capacitance that exceed corresponding individual thresholds set for each of the plurality of curved partial sleeves.

2. The earpiece of claim 1, wherein each of the corresponding individual thresholds are equal to each other.

3. The earpiece of claim 1, wherein the sleeve and the plurality of curved partial sleeves comprise copper.

4. The earpiece of claim 1, wherein the sleeve entirely wraps around the speaker.

5. The earpiece of claim 1, wherein the earpiece further comprises a battery disposed inside the housing, and wherein the plurality of curved partial sleeves are wrapped around the battery.

6. The earpiece of claim 1, wherein the corresponding individual thresholds are all different, and wherein a given threshold in the corresponding individual thresholds is greater than another threshold in the corresponding individual thresholds when a corresponding curved partial sleeve is closer to the stem relative to another curved partial sleeve.

7. The earpiece of claim 1, wherein the plurality of curved partial sleeves comprise four curved partial sleeves having semi-hemispherical cross-sectional shapes of equal size.

8. The earpiece of claim 7, wherein the preselected number comprises three of the four curved partial sleeves.

9. The earpiece of claim 8, wherein:

the corresponding individual thresholds comprise:

a second threshold associated with a first curved partial sleeve of the four curved partial sleeves, a third threshold associated with a second curved partial sleeve of the four curved partial sleeves, a fourth threshold associated with a third curved partial sleeve of the four curved partial sleeves, a fifth threshold associated with a fourth curved partial sleeve of the four curved partial sleeves, the first curved partial sleeve and the second curved partial sleeve are closer to the stem than the third curved partial sleeve and the fourth curved partial sleeve; and the second threshold and the third threshold are greater than the fourth threshold and the fifth threshold.

10. The earpiece of claim 1, further comprising:

a battery disposed inside the housing; and a processor in communication with the firmware, the sleeve, and the plurality of partially curved sleeves;

wherein:

the sleeve comprises copper, the sleeve entirely wraps around the speaker, the plurality of curved partial sleeves are wrapped around the battery, the plurality of curved partial sleeves comprise four curved partial sleeves comprising copper and having semi-hemispherical cross-sectional shapes of equal size, and the processor is configured to:

measure a first change in electrical capacitance of the sleeve, measure four changes in electrical capacitance of corresponding ones of the four curved partial sleeves, and set the earpiece to an "on ear" condition when the following conditions are satisfied:

the first change in electrical capacitance exceeds a first threshold, and three of the four curved partial sleeves have changes in electrical capacitance that exceed corresponding individual thresholds set for each of the four curved partial sleeves.

11. The earpiece of claim 10, wherein:

the corresponding individual thresholds comprise:

a second threshold associated with a first curved partial sleeve of the four curved partial sleeves, a third threshold associated with a second curved partial sleeve of the four curved partial sleeves, a fourth threshold associated with a third curved partial sleeve of the four curved partial sleeves, a fifth threshold associated with a fourth curved partial sleeve of the four curved partial sleeves, the first curved partial sleeve and the second curved partial sleeve are closer to the stem than the third curved partial sleeve and the fourth curved partial sleeve, and the second threshold and the third threshold are greater than the fourth threshold and the fifth threshold.

12. The earpiece of claim 10, wherein the corresponding individual thresholds further comprise:

at least one additional threshold associated with a difference in capacitance between any two of the four curved partial sleeves.

13. The earpiece of claim 11, wherein the corresponding individual thresholds further comprise:

a sixth threshold associated with a first difference in capacitance between the second curved partial sleeve and third curved partial sleeve;

a seventh threshold associated with a second difference in capacitance between the third curved partial sleeve and fourth curved partial sleeve;

an eighth threshold associated with a third difference in capacitance between the fourth curved partial sleeve and fifth curved partial sleeve;

a ninth threshold associated with a fourth difference in capacitance between the second curved partial sleeve and fourth curved partial sleeve;

a tenth threshold associated with a fifth difference in capacitance between the second curved partial sleeve and fifth curved partial sleeve; and an eleventh threshold associated with a sixth difference in capacitance between the third curved partial sleeve and fifth curved partial sleeve.

14. A method of activating an earpiece, the method comprising:

measuring a first change in electrical capacitance of a first sleeve disposed inside of a stem, wherein the electrical capacitance of the first sleeve is established between curved portions of the first sleeve;

measuring a plurality of changes in electrical capacitance of a corresponding plurality of curved partial sleeves partially wrapped inside of a housing attached to the stem;

activating the earpiece when the following conditions are satisfied:

the first change in electrical capacitance exceeds a first threshold; and a preselected number of the corresponding plurality of curved partial sleeves have changes in electrical capacitance that exceed corresponding individual thresholds set for each of the corresponding plurality of curved partial sleeves.

15. The method of claim 14, wherein the first threshold is greater than any of the corresponding individual thresholds.

16. The method of claim 15, wherein the corresponding individual thresholds are greater for curved sleeves closer to the stem relative to curved sleeves located farther from the stem.

17. The method of claim 14 wherein:

the corresponding plurality of curved partial sleeves comprises a second sleeve, a third sleeve, a fourth sleeve, and a fifth sleeve, and further comprises semi-hemispherical cross sections of equal size;

the corresponding individual thresholds comprise a second threshold associated with the second sleeve, a third threshold associated with the third sleeve, a fourth threshold associated with the fourth sleeve, and a fifth threshold associated with the fifth sleeve; and the preselected number comprises at least three of the second sleeve, third sleeve, fourth sleeve, and fifth sleeve.

18. The method of claim 17, wherein the first threshold is greater than any of the corresponding individual thresholds.

19. The method of claim 17, wherein the corresponding individual thresholds comprise a further threshold associated with a difference in capacitance between any two of the second sleeve, the third sleeve, the fourth sleeve, and the fifth sleeve.

20. The method of claim 17, wherein the second threshold, the third threshold, the fourth threshold, and the fifth threshold are all different.

21. A system comprising circuitry configured to:

measure a first change in electrical capacitance of a first sleeve disposed inside a stem of an earpiece, wherein the electrical capacitance of the first sleeve is established between curved portions of the first sleeve;

measure a plurality of changes in electrical capacitance of corresponding ones of a plurality of curved partial sleeves that are adjacent an inner surface of a wall of a housing of the earpiece, the housing connected to a proximal end of the stem; and set the earpiece to an "on ear" condition when the following conditions are satisfied:

the first change in electrical capacitance exceeds a first threshold; and a preselected number of the plurality of curved partial sleeves have changes in electrical capacitance that exceed corresponding individual thresholds set for each of the plurality of curved partial sleeves.

* * * * *